US006359987B1

(12) United States Patent
Tran et al.

(10) Patent No.: US 6,359,987 B1
(45) Date of Patent: Mar. 19, 2002

(54) MULTIMEDIA SPEAKER DETECTION CIRCUIT

(75) Inventors: Thanh T. Tran, Houston; Hiten N. Dalal; Kurtis J. Bowman, both of Cypress, all of TX (US)

(73) Assignee: Compaq Computer Corporation, Houston, TX (US)

( * ) Notice: Subject to any disclaimer, the term of this patent is extended or adjusted under 35 U.S.C. 154(b) by 0 days.

(21) Appl. No.: 08/857,258

(22) Filed: May 16, 1997

(51) Int. Cl.[7] ..... H04R 29/00
(52) U.S. Cl. ..... 381/58; 381/120; 381/123
(58) Field of Search ..... 381/56, 57, 120, 381/123, 58, 59, 121; 330/51

(56) References Cited

U.S. PATENT DOCUMENTS 4,549,147 A * 10/1985 Kondo ..... 330/297
5,008,631 A * 4/1991 Scherer et al. ..... 330/51
5,216,379 A * 6/1993 Hamley ..... 330/134
5,532,649 A * 7/1996 Sahyoun ..... 330/297
5,661,811 A * 8/1997 Huemann et al. ..... 381/86
5,796,854 A * 8/1998 Markow ..... 381/188
5,910,991 A * 6/1999 Farrar ..... 381/59

* cited by examiner

*Primary Examiner*—Forester W. Isen
*Assistant Examiner*—Brian Pendleton
(74) *Attorney, Agent, or Firm*—Sharp, Comfort Merrett, PC

(57) ABSTRACT

A computer system having automatic speaker detection circuitry is disclosed. The typical computer system includes a central processing unit, a data input device, and a sound card. Further, there is an audio amplifier, as well as an automatic detection and selection circuit that may be within the sound card or the audio amplifier or just part of the computer system as a whole. This automatic detection selection device is able to determine an impedance load of an output device attached to the computer system, namely, a speaker system, and is able to disable the audio amplifier within the computer system upon determining the impedance load and matching that impedance load against a selected value indicating that no amplification of the signal is required for the output device. Further, an audio sound equalizer is part of the system and can be bypassed in the same manner that the audio amplifier is, namely, that particular impedance load is measured indicating that no equalization is necessary.

10 Claims, 3 Drawing Sheets

64
TDA1517
98
OUT1
OUT2
PGND
SGND
VP
IN1
IN2
MUTE
UVRR
FILTER
L_HDPHN
R_HDPHN
122
124
C50
C14
C36
C30
C72
C69
C34
C70
C3
96
U23
R81
R96
120
R70
R66
R8
R6
C66
R67
C56
R38
94L
+A9V
U2
R33
C28
C41
R25
C7
R7
C1
R13
94R
R4
C19
R17
C12
114
118
116
AVDD
L_AMP
AREF
R_AMP
Q4
R102
Q13
R346
R100
Q15
R345
R127
C9
R27
C24
Q14
U19
+5V
R128
R150
SENSE
112
R178
R172
Q16
R208
Q17
R209
R207
A9V
R363
Q1
R122
C45
U18
R342
R135
R364
C425
110
MUTE
PWRGD
DETENB_

MULTIMEDIA SPEAKER DETECTION CIRCUIT

BACKGROUND OF THE INVENTION

1. The Field of the Invention

The present invention relates generally to audio systems implemented in computer systems and, more particularly, to an audio sound system having interchangeable speakers for use in a computer system. More particularly still, the present invention relates to an audio sound system where the computer system can distinguish between the type of speakers connected to the computer system and optimize the system according to the speakers then connected.

2. Prior Art

Computer systems have expanded to perform many functions and operations. One such function is to provide output and input for various media sources such as audio and video. In the audio portion of computer systems, sound cards have been gaining favor in computer systems. These sound cards, unfortunately, typically do not have adequate power to drive the speakers attached to the computer system.

The speakers that are attached to the computer system and receive the output signal from the sound card typically require internal amplification or self-amplification for driving the speakers. The sound signal comes from the sound card, but the power to drive the speakers themselves is provided by a second source other than the computer. As multimedia functions became better integrated in computer systems, there arose a need to provide direct sound amplification and equalization within the computer system to the speakers themselves. As these speakers became self-driven from the computer system, one problem of providing speakers with amplification and equalization has been overcome.

Once computer designers and builders integrated the amplifier into the computer system, additional integration was then desired. This integration was to optimize the speakers by using sound equalization to match the sound characteristics of the amplifier as well as match the amplifier to the sound characteristics of the speaker in order to improve the sound quality. This optimization required that the speakers be tailor designed towards the system itself and that the amplifier internal to the computer system also be tailored such that the equalization, sound separation, and signal boost and gain would be designed for the particular speakers integrated into the system as a whole. Unfortunately, this integration has led to yet another problem.

The integration of the speakers with the computer system is very much desirable; however, it has introduced the problem of the user lacking the flexibility of customizing the speakers to the user's own particular taste and pocketbook. For example, various add-on stereo speaker systems can provide much greater frequency response and sensitivity than some systems that are integrated into a computer system. When a user desires to swap out the original speakers for this new speaker system, typically these new multimedia speaker systems are self-amplified. Even when the speaker systems being self-amplified, the amplifier system built into the computer system attempts to drive these speakers, and there is a problem of having too much gain due to cascading of two power amplifiers, which causes severe audio distortion. This can be overcome simply by reducing the amplifier gain. Unfortunately, the stereo sound acoustics and optimization that is done within the amplifier is still passed on to the speakers in such a manner that the speakers, which have been optimized regardless of the system to which they are attached, are now corrupted in that extraneous signals and processing is being forced into the speakers and then the sound quality is degraded and the user is unhappy with the computer system or the new speakers or both.

Accordingly, what is needed is a solution to integrate computer systems with their own speaker system while offering the flexibility of swapping out the integrated speakers with custom-designed speakers selected by the user. The speakers can be either amplified or non-amplified in operation.

SUMMARY OF THE INVENTION

According to the present invention, a computer system having automatic speaker detection circuitry is disclosed. The typical computer system includes a central processing unit, a data input device, and a sound card. Further, there is an audio amplifier, as well as an automatic detection and selection circuit that may be within the sound card or the audio amplifier or just part of the computer system as a whole. This automatic detection selection device is able to determine an impedance load of an output device attached to the computer system, namely, a speaker system, and is able to disable the audio amplifier within the computer system upon determining the impedance load and matching that impedance load against a selected value indicating that no amplification of the signal is required for the output device.

Further, an audio sound equalizer is part of the system and can be bypassed in the same manner that the audio amplifier is, namely, that particular impedance load is measured indicating that no equalization is necessary. Additionally, a switching circuit is provided between a first input connector and the speaker load which is, the switching circuit is used to bypass the audio equalizer as well.

The significance of being able to detect from one speaker type to another speaker type is that some speakers are actively driven while other speakers are passively driven. When a speaker is actively driven, it means that it is self-contained with its own power supply and does not need signal amplification from the audio source. On the other hand, passively driven speakers require external amplification, typically from the external signal source. Since actively driven speakers do not need external driving sources, the amplification system in the computer system should be bypassed for optimal performance of the speakers. Likewise, speakers that are matched to the computer system that are passively driven, need the amplification within the stereo system and thus should not be bypassed. This automatic detection occurs when the speakers are connected to the system and the system is turned on and performs its initial power-on self-test and then invokes the BIOS calls for configuring the system with the appropriate components.

The speaker detection apparatus can be embodied in a speaker impedance load detection circuit. This impedance load determination circuit includes a first an input signal connector, a switch, a signal amplifier, an output signal connector, and detection circuitry. The input signal connector is coupled to the switch, as is the signal amplifier and output signal connector. The detection circuitry is coupled between the input signal connector, the signal amplifier, and the output signal connector and is used to detect the impedance value of the connected load so that it can select between a first and second input signal received on the input signal connector via the switch. What the circuit does is it takes the input signal, it passes it to a first channel unamplified or rather through a unity amplification and passes a second channel through an amplifier unit so that an appropriate amplification level can be obtained. Based upon the particular impedance load of the speakers detected, then either the unified or the unity amplified signal is passed to the speaker load, meaning that no amplification is necessary, or the amplified signal is passed to the speaker load, meaning that the speakers are passively driven.

The speaker impedance load determination circuit is such that the detection circuitry includes a capacitor coupled between the signal amplifier and output signal connector and a first switch coupled to the capacitor and the signal amplifier. This capacitor and first switch is arranged so that the capacitor is charged at such a time as to allow the first switch to activate and allow a voltage placed across the output signal connector to a speaker load and the switch in a manner so as to measure the voltage. Once this voltage is determined, then it is a standard calculation to determine the impedance value of the speaker load. Again, this switch is provided to either cut out the signal amplification or also to cut out any audio sound equalization that may be added as well. This speaker arrangement typically is a pair of speakers having a left channel and a right channel and are either self-powered or passively driven.

In order to carry out this particular selection technique, a method is provided for automatically selecting between a first speaker type and a second speaker type. This includes the system first determining an impedance level of the attached speaker load, then selecting the speaker amplification suitable for the attached speaker load based upon this determined impedance level. Additionally, the method can either provide signal equalization, which is based upon the impedance level determined during the initial steps. Further, the system determines the voltage level across the speaker load for calculating the impedance value based on this voltage level. Again, this particular method is performed during the initial power-on self-test within a BIOS call of determining which components are inherent in the system or attached so that proper configuration can be made.

DETAILED DESCRIPTION OF THE SPECIFIC EMBODIMENTS

Figure 1:
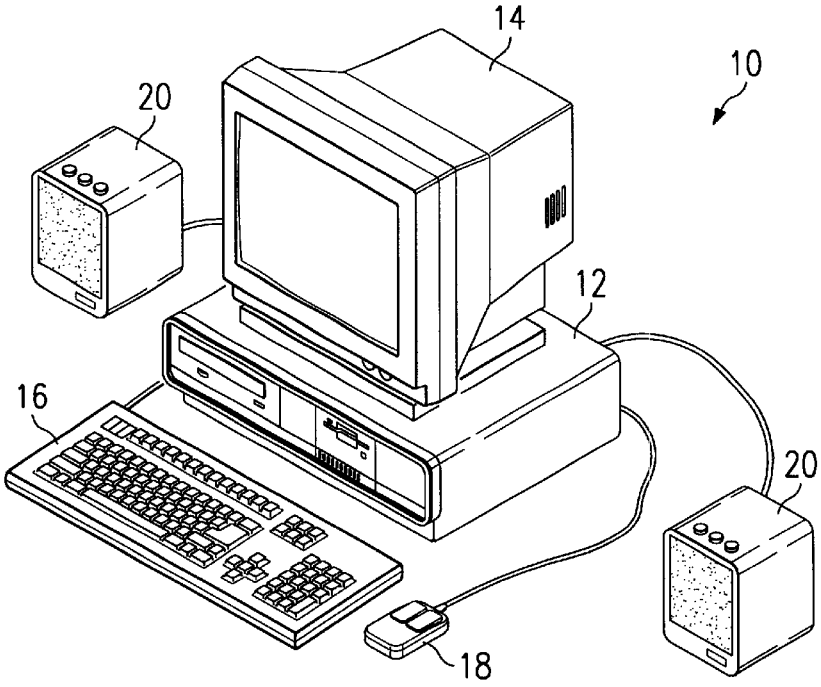
FIG. 1 is a block diagram depicting a computer system incorporating a speaker detection apparatus.

FIG. 1 depicts a computer system 10 implementing a speaker detection apparatus that is used to distinguish between speakers that are self-amplified as opposed to speakers that are to be amplified by the amplifier system incorporated into the computer system 10.

Computer 10 further comprises a computer processing unit 12, which connects to a monitor 14. Monitor 14 is used to view data outputted by computer processing unit 12. A keyboard 16 and a mouse 18 are connected to the computer processing unit 12 in order to allow the user to have input into computer processing unit 12. Within computer processing unit 12 are additional subsystems such as hard disk drive for long-term storage, a floppy disk drive for short-term storage, and a CD ROM player for long-term drive as well as for audio playback. Further connected to computer processing unit 12 are a pair of speakers 20. Speakers 20 are matched in such a manner as to complement the amplification characteristics of the amplifier that will be described later in the present application. Additionally, speakers 20 can represent self-amplified speakers that are custom designed independent of any particular computer system.

Computer processing unit 12 is capable of distinguishing between a first pair of speakers that are optimized to operate with computer processing unit 12 and computer system 10 in such a way as to take advantage of the amplification unit provided in computer processing unit 12. The system is able to distinguish from speakers that are self-amplified that do not need amplification from computer 10. In this manner, a user can customize the speakers that are used with the computer system 10 in such a way as to use either speakers that have been optimized for the computer system 10 or to use speakers that the user finds to his or her liking instead.

Figure 2:
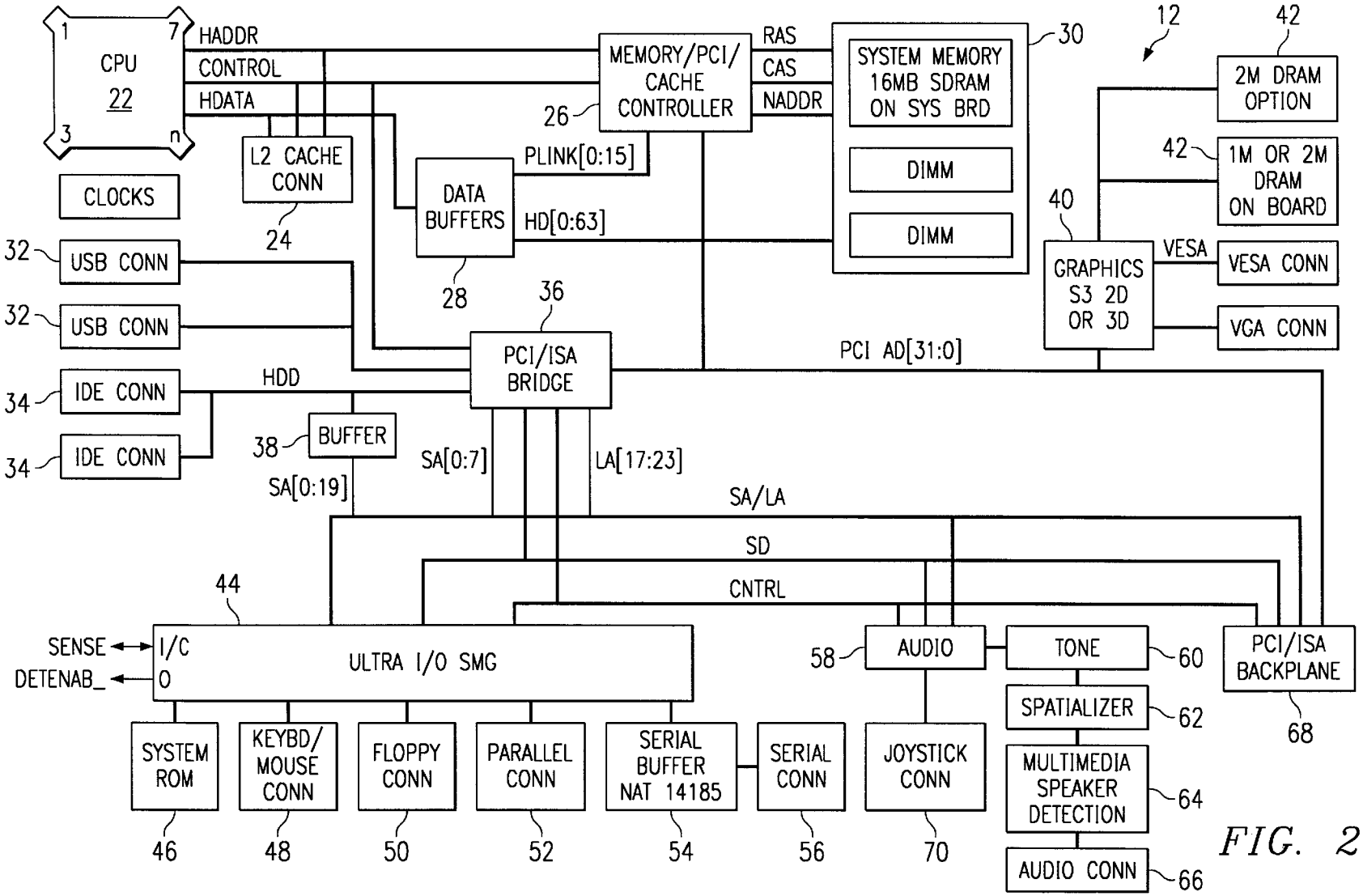
FIG. 2 depicts a block diagram of the computer processing system of FIG. 1.

Computer processing unit 12 is depicted in greater detail in FIG. 2. FIG. 2 is a block diagram of the computer processing unit 12 that includes the speaker sensing system used in the current invention.

In FIG. 2, there is a central processing unit (CPU) 22. CPU 22 can be any type of central processing unit. Typical CPU's are from the Intel family central processors in the IBM PC-compatible systems and may include the Pentium chip or Pentium-compatible computer chip. Attached to CPU 22 is a second-level cache 24 that may be optional. Additionally, CPU 22 is connected to a memory/PCI cache controller 26 that controls the system memory 30 as well as the level-two cache 24. Cache controller 26 is further connected to a data buffer 28 that is also coupled to system memory 30, as well as CPU 22. System memory 30 includes, but is not limited to, 16 megabytes of SDRAM on the system board and can include additional RAM modules in any configuration desired by the system designer.

CPU 22 is further connected to PCI/ISA bridge 36. This bridge 36 is further connected to Universal System Buss (USB) connectors 32 and IDE connectors 34. Between the IDE connectors 34 and the bridge 36 is a buffer unit 38. This buffer 38 provides buffering with the hard disk drive unit (not displayed) that is typically associated with and provided in the computer processing unit 12. The memory cache controller 26 and PCI bridge 36 are further connected to a graphics controller 40.

Graphics controller 40 is capable of operating either a VESA or VGA standard video monitor and is further connected to monitor 14 in the computer 10 of FIG. 1. The graphics controller 40 is further capable of providing video imaging in either a two-dimensional or three-dimensional environment. Further connected to graphics controller 40 are extra video RAM 42, which may include at least two megabytes of DRAM and either one to two megabytes of DRAM on the system board itself.

Computer processing unit 12 further includes an input/output (I/O) controller 44. I/O controller 44 further includes means for detecting whether amplified speakers are connected to the computer processing unit 12 or non-amplified speakers are connected to computer processing unit 12. In I/O controller 44 are a first SENSE line and a detect enable line. To round out the abilities of I/O controller 44, this controller is further capable of controlling the keyboard/mouse connector 48, a floppy drive 50, a parallel connector 52, a serial connector 56, which includes a serial buffer 54. Additionally, system ROM is controlled through I/O controller 44 and typically system ROM 46 includes the BIOS program, as well as other set up programs used in configuring computer processing unit 12.

Computer processing unit 12 further includes an audio processor/controller 58, which connects to the system bridge 36. Further connected to audio controller 58 are tone adjuster 60, signal spatializer 62, the multimedia speaker detection circuit 64, as well as audio connectors 66. Completing the final elements of computer processing unit 12 is a PCI/ISA backplane connector 68 and a joy stick connector 70.

A high-level diagram of computer system 12 has been illustrated in FIG. 2. It should be understood that the design and implementation of the general computer system is well-known to those skilled in the art, and it is left to the skilled artisan to implement according to the desires and needs of the end user.

Figure 3:
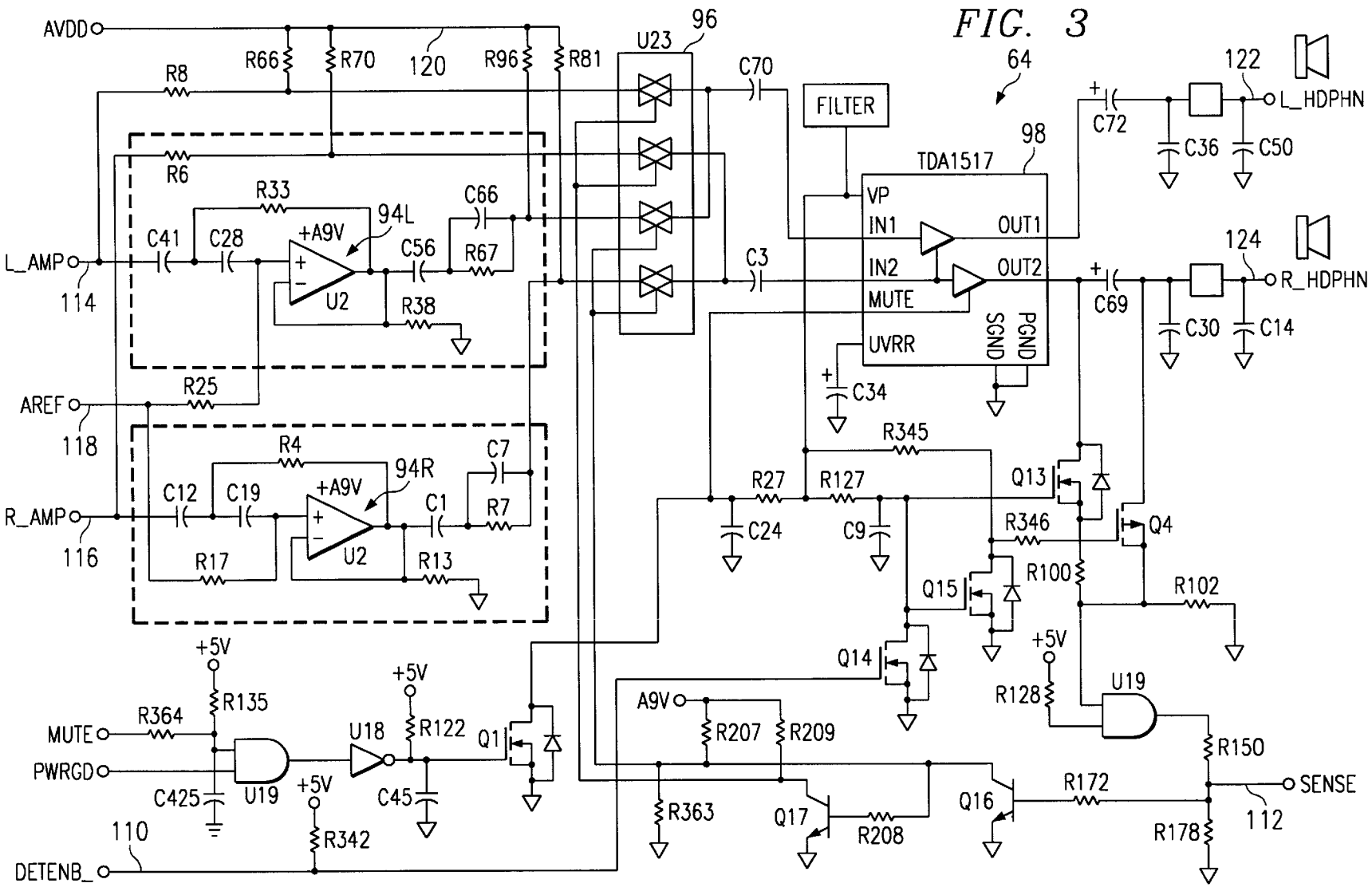
FIG. 3 depicts a schematic diagram of the sensing circuit incorporated in the computer systems of FIGS. 1 and 2.

In FIG. 3 there is a schematic diagram of the sensing circuit that is used to sense whether speakers attached to computer system 10 include self-amplification or are passive drive, i e., designed to work with the computer system or receive amplification from the computer system.

Multimedia speaker detector 64 is able to distinguish between actively driven and passively driven speakers attached to computer system 12 by distinguishing between the impedance level at the time of connection. At startup in the BIOS procedure, the system monitors the impedance level of the attached speaker 20. A passively driven speaker system typically has the impedance level of from two to eight ohms. In a system having self-amplification or is actively driven, the impedance can be as great as 10,000 ohms. The circuitry is set up so that the impedance connection can be readily distinguished one from another. Once the impedance level is determined, then the system disables the amplifier or the sound equalization in order to allow the speaker system that is actively driven to receive a signal that is relatively pure without equalization or amplification. Accordingly, when a self-driven speaker is sensed, then also the gain is lowered and the equalizer integrated in the computer is bypassed.

Additionally, the circuit is designed so that it can distinguish between two classes of audio speakers. These classes can include a high-end speaker design that operates around ten watts per channel and a low-end system that operates around five watts per channel. High-end speakers have audio amplifiers built into the speaker cabinet while the low-end speaker system is driven by the amplifier built into the CPU 12. The low-end audio system uses a fixed equalizer to boost the low frequency for better bass response, and this causes audio performance degradation when the low-end audio CPU is connected with the high-end speakers. This problem is overcome in that another detection circuit is provided that protects the particular speaker load attached to the system. This allows the system to select the right frequency response for either the highend speakers or the low-end speakers.

The sensing circuit and amplifier of FIG. 3 includes a driving voltage $V_{DD}$ with the voltage difference being between $V_{DD}$ and ground. Further inputted in the detection circuit are a left amplification signal on input line 114 and a right amplification signal on input line 116. A reference voltage on line 118 is also provided. Another input signal is speaker detection enables signal DETENB_on line 110. Various output signals include the left channel output on line 22 and the right channel output on line 124. Further, there is a SENSE signal on line 112 determining whether to activate an amplifier section 94 for passive speakers or for active speakers.

The left channel input signal on line 114 proceeds to amplification section 94L, which is similar to the amplification section 94R used for the right channel input signal. The reference signal on line 118 leads to both input amplifiers U2. The amplified signals then proceed to a multiplexer 96 (U23). Both an amplified and unamplified signal from both the left channel and the right channel are sent to the multiplexer 96 for selecting between either the amplified or the unamplified signal based upon the type of speakers attached to the sound system. If actively driven speakers are attached, then the unamplified signals are channeled to the signal outputs 122,124 through the left channel (via R8) and the right, channel (via R6) respectively. Whereas, if passive speakers are attached to the sound system, then the amplified signala are channeled via the left and right channel, amplifier sections 94L and 94R respectively. The selected signals are directed through audio amplifier unit 98. Additionally, four switches, a transistor Q14, transistor Q15, transistor Q16, and transistor Q4 are provided together with transistors Q16, Q17 for the actual sensing and switching between passive and active speakers.

Each transistor Q14, Q15, Q16 is an N-channel MOSFET transistor. Switch Q14 is driven by the DETENB_signal, which is asserted during the system BIOS for speaker detection. Switch Q14 is connected as an inverter and the input on Q14 is driven low by DETENB_signal forcing the transistor to go to the high state. When transistor Q2 goes to the high state, both transistor switch Q15 and Q16 are turned on. When Q13 goes high, its output drives, or turns on, switch Q4, which is a P-channel transistor. Both switch Q4 and Q15 are on during the detection stage.

When transistors Q15 and Q4 are on, a DC current flows through the transistors and sets up a voltage at the input of the AND gate 100 (U19). This voltage varies depending on the speaker load at the right channel speaker signal. When passive speakers, typically ranging 2 to 8 ohms, are connected to right output channel signal, the voltage set up at pin 4 of AND gate 100 is equal to 0.01V, which is a low state for the CMOS circuit. The calculation of this voltage occurs as follows. The 6-volt $V_{DD}$ signal is placed across the resistive value (20K ohm of R102 divided by the resistor value of the load, typically 8 ohms). This value is then divided by the same load of resistor R100 in a standard divider circuit. This resistor value is set at 4.7K ohm in this implementation.

When an active speaker is connected to the right output channel, the voltage at input 4 on AND circuit 100 is equal to 3.5V, which is a high state for CMOS logic (AND gate output=1). The calculation is as follows. The 6V from the amplifier drops across the circuit of R102 divided by the high impedance load of the active speaker, which is 10K ohm, this total is then divided by the combined value of the R102 divided by the combined 10K impedance and 4.7K impedance of R100.

The output of AND gate 102 then drives the SENSE signal that sends a message to the system BIOS. The system during the BIOS operation reads the state of the SENSE signal to determine if the speaker is active or passive i.e. AND output=1 indicates active speak connected; AND gate output=0 indicates passive speakers connected. After determining the speaker type, the BIOS changes the SENSE signal line 112 to be an input to the switching circuit Q16, Q17 and deasserts the DETENB_signal on line 110.

Afterwards, the BIOS then writes a "0" logic to the SENSE input line 112 enable to the high gain and equalized signal path via amplifiers 94L and 94R for the passive speaker and writes a "1" logic to enable the low gain and nonequalized signal paths (via R6 and R8) for active speakers through multiplexer 96. The equalizer circuit couples between the input signal lines 114, 116 and multiplexer 96. The multiplexer 96 is enabled so that the nonequalized and low-gain path are pursued when the active speaker selection signal is high, SENSE=high (Q16 on, Q17 off). The switch is enabled for the equalized and high-gain path when the passive speaker selection signal is low, meaning that the SENSE signal is low (Q16 on, Q17 off). This detection and switching sequence is repeated by the computer during every BIOS procedure. BIOS procedures typically occur during the powering on and off of the sound system, which, in this case is a computer system.

The remaining elements, such as the capacitors, inductors and resistors illustrated in the schematic of FIG. 3 simply aid in completing the details of the circuit and follow sound engineering practices of smoothing out the input signal controlling the deviations, and providing consistent voltage and current sources for operation.

Figure 4:
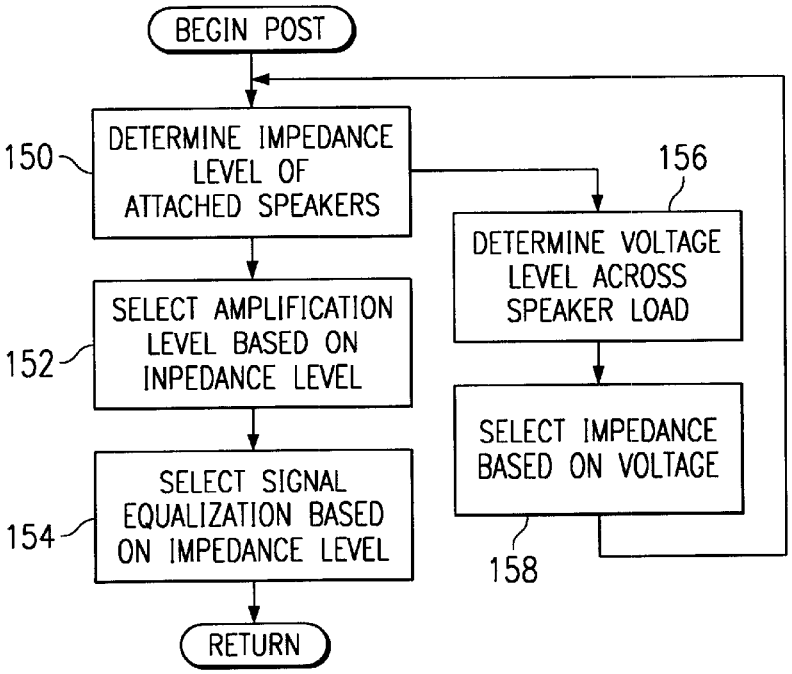
FIG. 4 is a flow diagram of the steps taken to detect a speaker system based on its impedance value.

FIG. 4 depicts a block diagram of the steps implemented in detecting a speaker system and making a proper amplification selection. In block 150, the system determines the impedance level of an attached set of speakers. Next, in block 152, the system selects the proper speaker amplification suitable for the attached speaker load based on the determined impedance level. This impedance level is based on whether the speakers have high impedance or low impedance, indicating that either the speakers are self-powered or are passively driven. Next, in block 154, the system provides signal equalization for outputting based upon the appropriate speaker impedance value.

In order to calculate the impedance value of the speaker load, the system determines in block 156 what the voltage level is across the speaker load, and then, in block 158, selects the impedance value based upon the voltage level. Again, this is all performed during the initial power-on self-test within a BIOS call of the computer configuration program. It is contemplated, however, that the system may be a plug-andplay type that can be hot plugged in so that the automatic detection occurs once the speakers are attached regardless of the state of the system being on or off.

With this invention, a multimedia computer is now able to detect automatically between different types of speakers attached to it. With different types of speakers being automatically detected, the built-in amplifier as well as boost and gain can be minimized when self-powered speakers. Additionally, in a system where two standards have been designed to attached to the system, either standard may be selected by the switching system that is disclosed. This design of automatically selecting between two types of systems can be integrated in a single circuit, which eliminates the need to build separate audio boards to handle the different grades of audio systems that can be implemented in a computer system. This also reduces the costs of manufacturing the computer in that only one standard audio circuit is designed and then customized to be utilized by different types of sound speakers.

The foregoing disclosure and description of the invention are illustrative and explanatory thereof, and various changes in the size, shape, materials, components, circuit elements, wiring connections and contacts, as well as the details of the illustrated design and construction and method of operation may be made without departing from the spirit of the invention.

What is claimed:

1. A computer system comprising:

a central processing unit;

a monitor, coupled to said central processing unit;

a data input device, coupled to said central processing unit;

audio signal output channel circuitry providing separate first and second output channels for connection to respective speakers;

associated with each of said first and second output channels, first and second audio signal transmission paths each said first transmission path providing relatively high amplification, and each said second transmission path providing relatively low amplification, a first audio signal input commonly connected to both said first and second audio signal transmission paths associated with said first output channel and a second audio signal input commonly connected to both said first and second audio signal transmission paths associated with said second output channel;

impedance detection circuitry coupled to said audio signal output channel circuitry, said impedance detection circuitry operable to detect, when speakers are connected to said audio signal output channel circuitry, whether said speakers are passively driven speakers having a relatively low impedance level or self-driven speakers having a relatively high impedance level;

and switch circuitry operable to couple said first and second audio signal output channels (a) to receive over the relatively high amplification first transmission paths, audio signals input to said first and second audio signal inputs 1 when the detected impedance level corresponds to said passively driven speakers having said relatively low impedance level, and (b) to receive over the relatively low amplification second transmission paths, audio signals input to said first and second audio signal inputs when the detected impedance level corresponds to said self-driven speakers having said relatively high impedance level.

2. The computer system according to claim 1, wherein said audio signal input paths and said audio signal output paths provide left channel and right channel signal paths.

3. The computer system according to claim 1, wherein said switch circuitry comprises a multiplexer having a plurality of inputs connected to receive audio signals from respective ones of said audio signal input paths and having outputs connected to respective ones of said audio signal output channels.

4. The computer system according to claim 1, wherein each of said audio signal output channels includes an audio amplifier.

5. The computer system according to claim 1, wherein said impedance detection circuitry is operable to connect a voltage divider in parallel with a speaker impedance when connected to said audio signal output circuitry thereby to produce a voltage divider output voltage which has a logic level determined according to whether the speaker impedance is relatively high or relatively low.

6. The computer system according to claim 1 wherein said detection circuitry and said switch are operable under control of said processor during an initial power on self test routine.

7. A computer system comprising:

a central processing unit;

a monitor, coupled to said central processing unit;

a data input device, coupled to said central processing unit;

a controller;

audio signal output channel circuitry providing a pair of separate channels for connection to respective loudspeakers;

respective pairs of audio signal input paths each pair of audio signal input paths providing a different amplification level, one audio signal input path in each said pair coupled to a first common audio signal input terminal and the other audio signal input path in each said pair coupled to a second common audio signal input terminal;

impedance detection circuitry coupled to said audio signal output channel circuitry and to said controller;

said controller operable to enable said impedance detection circuitry to produce a detection logic output signal when speakers are connected to said audio signal output channel circuitry, said logic output signal having a logic level determined by whether said impedance detection circuitry detects a relatively low impedance level associated with passive speakers or detects a relatively high impedance level associated with self-driven speakers, said controller coupled to said impedance detection circuitry to receive said logic output signal;

said controller also coupled to supply to switching circuitry, a switch actuating signal having a logic level determined according to the logic level of said detection logic output signal to operate said switching circuitry to couple said audio signal output channels to a corresponding pair of said audio signal input paths, said corresponding pair of audio signal input paths being selected dependent upon the logic level of said detection logic output signal, to connect to said audio signal output channels either (a) to a pair of said audio signal input paths having a relatively low amplification level appropriate to the detected relatively high impedance level associated with self-driven speakers to transfer to said self-driven speakers, relatively low amplification level reproductions of audio signals received at said first and second common audio signal input terminals or (b) to a pair of said audio signal paths having a higher amplification level appropriate to detection of passive speakers having said relatively low impedance to transfer to said relatively low impedance speakers, relatively high amplification level reproductions of audio signals received at said first and second common audio signal input terminals.

8. The computer system according to claim 7, wherein each path in one pair of said audio signal paths includes an audio amplifier and sound equalizer.

9. The computer system according to claim 7, wherein the audio signal paths in a first pair of said audio signal paths each provides audio signal amplification and equalization between audio input circuitry and said switching circuitry and the audio signal paths in the other pair of said audio signal paths each provides a unity gain signal path between said audio input circuitry and said switching circuitry; and wherein said switching circuitry is operable to select said first pair of audio signal paths when said detection circuitry detects a relatively low impedance associated with passive speakers connected to said audio signal output circuitry, and to select said second pair of audio signal paths when said detection circuitry detects said relatively high impedance associated with self-driven speakers connected to said audio signal output circuitry.

10. The computer system according to claim 7, wherein said switching circuitry includes a multiplexer having a pair of outputs coupled to said pair of audio output channels, said multiplexer having inputs coupled to receive signals from respective ones of said audio signal paths.

* * * * *